US005083943A

United States Patent [19]

Tarrant

[11] Patent Number: 5,083,943

[45] Date of Patent: Jan. 28, 1992

[54] CATV ENVIRONMENTAL F-CONNECTOR

[75] Inventor: Dennis E. Tarrant, Newtown, Conn.

[73] Assignee: Amphenol Corporation, Wallingford, Conn.

[21] Appl. No.: 437,162

[22] Filed: Nov. 16, 1989

[51] Int. Cl.[5] ..... H01R 17/04

[52] U.S. Cl. ..... 439/583; 439/585

[58] Field of Search ..... 439/578-585

[56] References Cited

U.S. PATENT DOCUMENTS

| | | | |
|---|---|---|---|
| 3,221,290 | 11/1965 | Stark et al. | 339/177 |
| 3,319,211 | 5/1967 | Smith et al. | 339/31 |
| 3,587,033 | 6/1971 | Brorein et al. | 339/89 |
| 3,678,446 | 7/1972 | Siebelist | 439/583 |
| 3,739,076 | 6/1973 | Schartz | 439/583 |
| 3,810,076 | 5/1974 | Hutter | 339/177 R |
| 4,059,330 | 11/1977 | Shirey | 339/177 |
| 4,273,385 | 11/1979 | Fenn et al. | 339/177 E |
| 4,395,085 | 7/1983 | Inoue | 339/94 R |
| 4,509,816 | 4/1985 | Freitag | 339/177 R |
| 4,613,199 | 9/1986 | McGeary | 339/177 R |
| 4,684,201 | 8/1987 | Hutter | 439/585 |
| 4,687,272 | 8/1987 | Spinner et al. | 439/271 |
| 4,696,532 | 9/1987 | Mattis | 439/863 |
| 4,707,047 | 11/1987 | Michaels et al. | 439/271 |
| 4,755,152 | 7/1988 | Elliot et al. | 439/452 |
| 4,824,399 | 4/1989 | Bogar et al. | 439/578 |
| 4,824,400 | 4/1989 | Spinner | 439/578 |

*Primary Examiner*—Joseph H. McGlynn
*Attorney, Agent, or Firm*—Bacon & Thomas

[57] ABSTRACT

An F-type coaxial cable connector includes a tapered interface surface for even compression of the interface gasket and prevention of shearing. The cable is retained in the connector by a crimping arrangement including a cylindrical outer ferrule designed with a series of protruding ridges and an inner body of the connector which has a series of V-shaped ridges, the size and shape of the ridges being optimized for both cable retention and waterproofing. The interface is also part of inner body, thus minimizing the number of the loose or secondary parts required for installation. A groove in the inner body accomodates a second o-ring located between a coupling nut and the inner body.

18 Claims, 2 Drawing Sheets

CATV ENVIRONMENTAL F-CONNECTOR

BACKGROUND OF THE INVENTION

1. Field of the Invention

This invention relates to coaxial cable connectors of the type used in CATV systems.

2. Description of Related Art

Coaxial cable connectors which are threaded onto complimentary interface connectors are commonly used for the purpose of electrically integrating coaxial cables with various electronic devices such as televisions, citizens band radios, FM radios, and amateur radio systems. A standard for such coaxial cables in the "F"-type connector. F-type connectors have attained near universal application in video and cable T.V. systems.

A primary function of F-type coaxial cable connectors is to ensure good engagement between the shield element of the coaxial cable and the conductive connector body for the purpose of electrical signal transmission to a connector interface. A problem with prior art coaxial connectors is that moisture can infiltrate into the connector body, between the connector body and the coaxial cable or between the connector body and the interface connector. This is especially true in the case of cable T.V. systems which frequently require outdoor connections.

Moisture infiltration between the connector body and the coaxial cable is believed to be the result, at least partly, of the manner in which the connectors are crimped to the cable. Conventional crimping tools do not apply a uniform compression force on the outer surface of the connector body at the point of crimping. Generally, such tools are hexagonal and leave several uncompressed or partially compressed zones between the jacket seal and the coaxial cable jacket. These zones are possible avenues for moisture infiltration. Also, the connectors themselves are not designed to take into account the curvature or variations in diameter of the cable at the point of crimping. Infiltrated moisture may eventually contact the braided shield and degrade the signal transmission performance of the connector.

Moisture infiltration which occurs between the interface connector and the connector body, on the other hand, generally results from an improper o-ring seal in the conventional connector. Again, such moisture infiltration may degrade the signal transmission performance of the connector. While o-ring seals are generally satisfactory, it is possible for the o-ring to become improperly seated or unevenly compressed when making the connection, resulting in possible shearing of the ring and RF leakage, as well as moisture infiltration past the ring.

A final problem in regard to F-type coaxial cable connectors is that a different connector structure is required for different types of commonly used coaxial cables even if the sizes of the cables are the same. In order to accommodate the different cable styles, adaptors or additional parts are often required, adding to cost and to the number of gaps through which moisture can penetrate.

SUMMARY OF THE INVENTION

It is an object of the invention to provide a signal connector which is designed to accommodate all styles cable within a given cable size and which is weather proof at both the interface and the cable entry.

It is a further object of the invention to provide a coaxial cable connector which requires no loose or secondary parts for installation and which provides excellent cable retention.

It is a still further object of the invention to provide an F-type connector with low contact resistance and excellent RF shielding qualities, and in which transfer impedance is virtually unaffected.

These objects are accomplished by providing a cable connector which employs a uniquely designed interface shape. The outer edge of the interface surface is tapered, allowing for even compression of the interface gasket and prevention of shearing. By preventing the gasket from remaining between interface surfaces, undesirable RF leakage is reduced and the gasket retains its sealing effect for a greater number of rematings.

Further waterproofing is provided by a second o-ring located between the coupling nut and the body. The body itself uses a circular crimp which meets both the waterproofing and cable retention requirements on all styles of coaxial cable. The cable is retained between a cylindrical outer ferrule designed with a series or protruding ridges, and an inner body of the connector which has a series of V-shaped ridges. The size and shape of these ridges are optimized for both cable retention and waterproofing.

BRIEF DESCRIPTION OF THE DRAWINGS

FIG. 1(*b*) is an enlarged cross-sectional view showing the cable retention portion of the inner body shown in FIG. 1(i a).

FIG. 4(*b*) is a front view of the coupling nut of FIG. 4(*a*).

FIG. 5(*b*) shows the connector of FIGS. 5(*a*) in an uncrimped condition prior to final crimping.

DETAILED DESCRIPTION OF THE PREFERRED EMBODIMENTS

Figure 3:
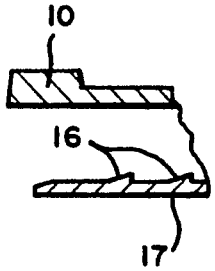
FIG. 3 illustrates the relative positions of the cable retention portions of the inner body of FIG. 1 and the ferrule of FIG. 3 when assembled together according to a preferred embodiment of the invention.
Figure 4A:
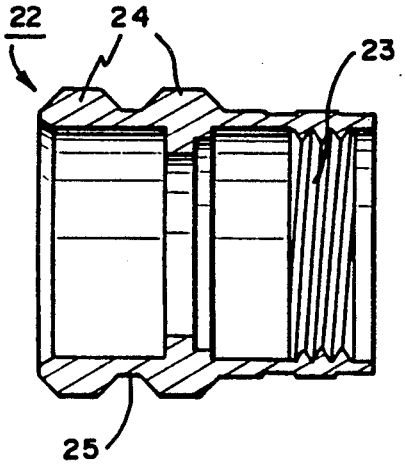
FIG. 4(*a*) is a cross-sectional side view of a coupling nut for with a coaxial cable connector according to a preferred embodiment of the invention.
Figure 4B:
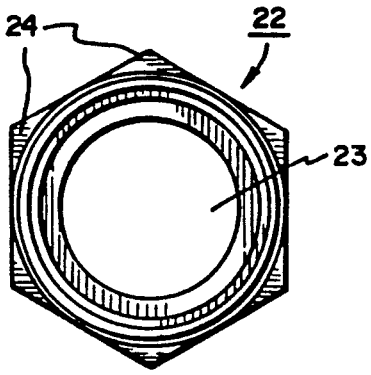
Figure 5A:
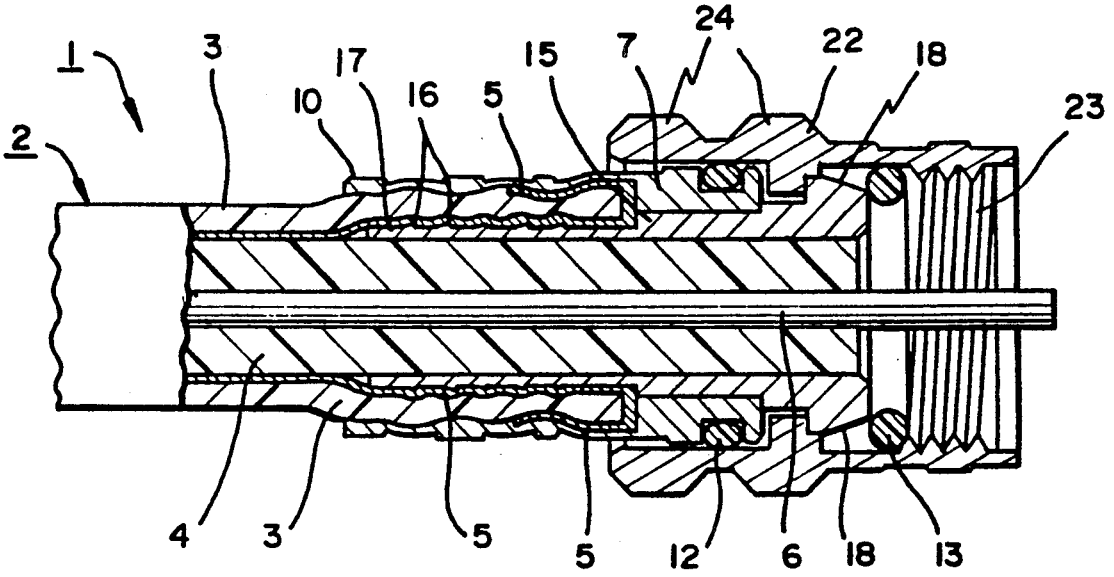
FIG. 5(*a*) is a cross-section side view of a completed F-type connector assembled using the parts shown in FIGS. 1–4.
Figure 5B:
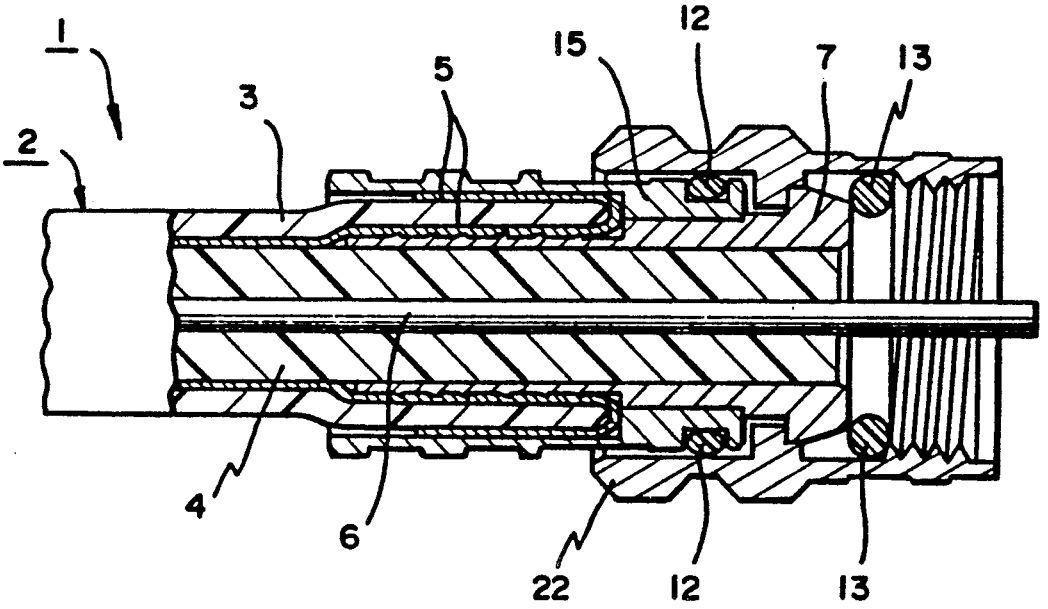

FIGS. 1–4 show separately the three parts which together make up the F-type connector 1 depicted in FIG. 5. The three parts are the inner body 15, illustrated in FIG. 1, the outer ferrule 7, illustrated in FIG. 2, and coupling nut 22, shown in FIG. 4. Each of the parts shown in FIGS. 1–5 is cylindrical in shape, the cross-sections being taken along a plane which axially bisects the connector. All dimensions in the illustrated connector are those of a standard F-type connector, except as otherwise indicated, although other size connectors are also intended to be included within the scope of the invention.

Figure 1A:
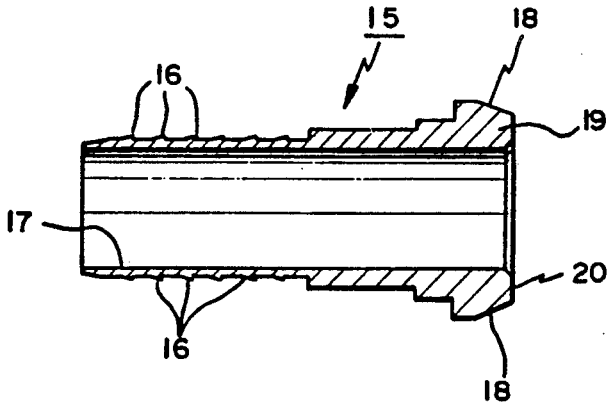
FIG. 1(*a*) is a cross-sectional view of the inner body of a coaxial cable connector according to a preferred embodiment of the invention.
Figure 1B:
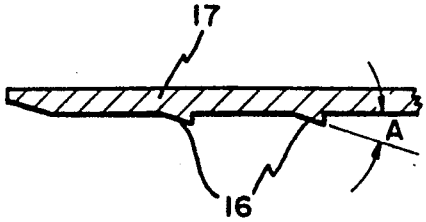

The inner body shown in FIG. 1(*a*) includes both a cable retention section 17 and an interface section 19. Interface section 19 includes a flat annular interface surface 20 adapted to mate with a corresponding flat annular interface surface on the interface connector or on another cable connector. The connector of the preferred embodiment is designed to be used with a standard female interface (not shown), but those skilled in the art will readily recognize the adaptability of the preferred connector for use with other interfaces or types of connector.

Interface section 19 includes a tapered surface 18 which provides space for expansion of an o-ring or gasket during mating without shearing or compression of the o-ring into the space between the mating annular interface surfaces. The tapered surface 18 provides the dual advantages of decreased moisture infiltration and also prevention of RF leakage through gaps resulting from non-uniform contact between the metal interface surfaces.

Turning to the cable entry portion of the connector, cable retention portion 17 is provided with ridges 16 for retaining the cable shield after crimping and to prevent entry of moisture at this point. The amount of protrusion of ridges 16 is critical. If the ridges do not extend far enough, cable retention will be insufficient. However, excessive protrusion will result in a gullotine effect causing severing of the cable braid during crimping. For the connector embodiment shown, which is designed to be used with RG-6U and related CATV coaxial cables, ridges having a 15° angle A, as shown in FIG. 1(*b*), and a height of 0.002 to 0.004 inches have proven optimum.

Crimping is accomplished by a tool having a circular crimping surface. This ensures uniform engagement between the ferrule and the cable for maximum protection against moisture infiltration and cable retention. An outer crimping ferrule 7 is provided with a specially designed crimping portion for the purpose of ensuring uniform contact between the cable and the connector.

Figure 2:
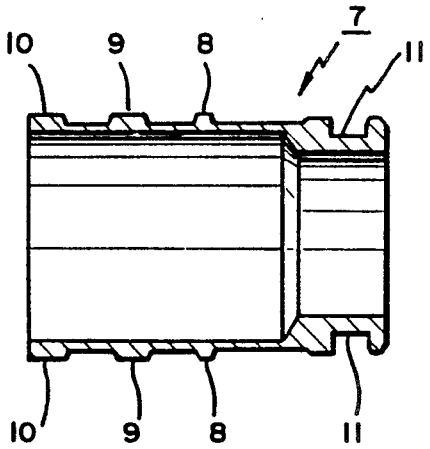
FIG. 2 is a cross-sectional view of the outer ferrule of a coaxial cable connector according to a preferred embodiment of the invention.

Outer ferrule 7 includes a series of protruding ridges 8, 9, and 10. The portion of the ferrule is manufactured using an annealing process to facilitate crimping. The crimping action compresses jacket 3 and braid 5 of the cable between the ferrule and the inner body 15. The setback as shown in FIG. 3 compensates for the curvature of the jacket and braid to maximize waterproofing effectiveness. Waterproofing is also aided by second o-ring is located in groove 11 in outer ferrule 7, as shown in FIGS. 2 and 5.

Inner body 15 is located within outer ferrule 7 as shown in FIGS. 5(*b*). FIG. 3 shows the manner in which ridge 10 of ferrule 7 and the end of retention portion section 17 of inner body 15 are offset. The spacing of the ridges and the offset between the outer ferrule 7 and inner body 15 permit the ferrule to adapt to the cable in order to provide maximum cable retention and waterproofing after crimping.

Cable braid 5 may be folded over jacket 3 as shown in FIG. 5, or, in the case of larger cable sizes and variations of the preferred F-type connector, the cable shield may simply extend along the inner side of jacket 3. The inner surface of inner body 7 includes a bore dimensioned to fit dielectric 4 of the coaxial cable, also as shown in FIG. 5.

The third and final discrete element of the connector of the preferred embodiment is coupling nut 22 shown in FIG. 4. This is the only part which is not completely cylindrical in shape. Instead, hexagonal surfaces 24, best seen in FIGS. 4(*b*), are included for the purpose of facilitating coupling of the coupling nut to an externally threaded coupling nut on the female connector.

Coupling nut 22 is essentially conventional in configuration. A groove 25 is included which extends around the circumferential of the coupling nut in the case of an RG-6 compatible connector of the type shown in FIGS. 1-5. However, as is known in the art, groove 25 may be omitted. The omission of the groove 25 indicates to those skilled in the art that the connector has an RG059 coaxial cable comparability, rather than an RG-6 compatibility.

It will of course be appreciated by those skilled in the art that the improved waterproofing and cable retention associated with the present invention will find application in connection with connectors other than F-type coaxial cable connectors. While the invention has been described specifically in the contact of F-type connectors, it is intended that the invention not be limited thereto, but rather that it is limited only in accordance with the appended claims.

I claim:

1. A coaxial cable connector, comprising:

a coupling member including an outer shell having coupling means for coupling the coaxial cable connector to a corresponding second coupling means on a second connector;

a generally cylindrical inner body disposed within said coupling member and including an annular interface surface arranged to mate with a correspondingly interface surface in said second connector, said interface surface lying generally in a plane perpendicular to the axis of the connector, said inner body also including a second surface extending from the perimeter of said interface surface at an oblique angle from said plane;

an o-ring disposed between said coupling means and said inner body at the intersection between said interface surface and said second surface, said o-ring forming an environmental seal when said coupling member is coupled with said corresponding second coupling means on said second connector;

an engaging portion of said inner body, said engaging portion including cable retention means extending around the circumference of said cylindrical inner body for securing said cable within said connector; and an outer ferrule disposed between said coupling member and said inner body, said ferrule and said engaging portion of said inner body cooperating to provide both cable retention and prevention of moisture infiltration when crimped.

2. A connector as claimed in claim 1, further comprising a second o-ring retained between said outer ferrule and said coupling member.

3. A connector as claimed in claim 2, wherein said second o-ring is seated in a groove in said outer ferrule.

4. A connector as claimed in claim 1, wherein said cable retention means comprises triangular projections, one side of each triangular projection extending from said engaging portion at a right angle and a second side intersecting said one side to form a barb, the one side facing the interface side of said inner body.

5. A connector as claimed in claim 4, wherein said coaxial cable includes an inner conductor, an outer conductor, a dielectric member between said inner conductor and said outer conductor, and an insulating jacket surrounding and outer conductor, said triangular projections having a height of less than the thickness of said outer conductor.

6. A connector as claimed in claim 1, wherein said outer ferrule includes ridges located around the circumference of said ferrule and arranged to facilitate engagement between said ferrule and said cable when crimped.

7. A connector as claimed in claim 1, wherein said outer ferrule extends further from said interface than said engaging portion of said inner body.

8. A cable connector as claimed in claim 1, wherein said coupling means comprises internal threads adapted to threadingly engage external threads of said second connector.

9. A connector as claimed in claim 1, wherein said coaxial cable connector is an F-type connector.

10. A coaxial cable including a coaxial connector, said connector comprising: a coupling member including an outer shell having coupling means for coupling the coaxial cable connector to a second connector;

a generally cylindrical inner body disposed within said coupling member and including an annular interface surface arranged to mate with a corresponding interface surface in said second connector, said interface surface lying generally in a plane perpendicular to the axis of the connector, said inner body also including a second surface extending from the perimeter of said interface surface at an oblique angle from said plane;

an o-ring disposed between said coupling means and said inner body at the intersection between said interface surface and said second surface, said o-ring forming an environmental seal when said coupling member is coupled with said corresponding second coupling means on said second connector;

an engaging portion of said inner body, said engaging portion including cable retention means extending around the circumference of said inner body for securing said cable within said connector; and an outer ferrule disposed between said coupling member and inner body, said ferrule being crimped by a circular crimping tool to retain said cable within said connector in cooperation with said retention means on said inner body.

11. A cable as claimed in claim 10, said connector further comprising a second o-ring retained between said outer ferrule and said coupling member.

12. A cable as claimed in claim 11, wherein said o-ring is seated in a groove in said outer ferrule.

13. A cable as claimed in claim 10, wherein said connector retention means comprises triangular projections, one side of each triangular projection extending from said engaging portion at a right angle and a second side intersecting said one side to form a barb, the one side facing the interface side of said inner body.

14. A cable as claimed in claim 13, wherein said connector includes an inner conductor, an outer conductor, a dielectric member between said inner conductor and said outer conductor, and an insulating jacket surrounding said outer conductor, said triangular projections having a height of less than the thickness of said outer conductor.

15. A cable as claimed in claim 10, wherein said outer ferrule include ridges located around the circumference of said ferrule and arranged to facilitate uniform contact between said ferrule and said cable when crimped.

16. A cable as claimed in claim 10, wherein said outer ferrule extends further from said interface than said engaging portion of said inner body.

17. A cable as claimed in claim 10, wherein said coupling means comprises internal threads adapted to threadingly engage external threads of said second connector.

18. A cable as claimed in claim 10, wherein said connector is an F-type connector.

* * * * *